US005241974A

United States Patent [19]

Tsai

[11] Patent Number: 5,241,974

[45] Date of Patent: Sep. 7, 1993

[54] HAIR APPLIANCE FOR DIRECTING WARM AIR TO HAIR

[75] Inventor: Feng-Chou Tsai, Kaohsiung, Taiwan

[73] Assignee: Ta-Wei Chen, Tainan Hsien, Taiwan

[21] Appl. No.: 981,228

[22] Filed: Nov. 25, 1992

[51] Int. Cl.[5] ..... A45D 19/16

[52] U.S. Cl. ..... 132/272; 34/97

[58] Field of Search ..... 132/112, 227, 228, 272; 34/96, 97

[56] References Cited

U.S. PATENT DOCUMENTS

| | | | |
|---|---|---|---|
| 3,702,616 | 11/1972 | Mercer | 132/272 |
| 3,721,250 | 3/1973 | Walter et al. | 132/112 |
| 3,745,306 | 7/1973 | Naritomi | 34/97 |
| 3,814,898 | 6/1974 | Levine | 132/112 |
| 3,947,659 | 3/1976 | Ono | 34/97 |
| 4,114,022 | 9/1978 | Braulke, III | 34/97 |
| 4,166,473 | 9/1979 | Bauer et al. | 132/272 |
| 4,523,080 | 6/1985 | Bolton | 34/97 |
| 4,605,019 | 8/1986 | Reynolds et al. | 34/96 |
| 4,835,879 | 6/1989 | Egelstad | 34/97 |
| 4,972,065 | 11/1990 | Ohlsen | 34/97 |

*Primary Examiner*—Gene Mancene
*Assistant Examiner*—Frank A. LaViola
*Attorney, Agent, or Firm*—Sughrue, Mion, Zinn, Macpeak and Seas

[57] ABSTRACT

A hair appliance for directing a stream of warm air towards the hair includes an elongated barrel having an air inlet and an air outlet opposite to the air inlet. An electric heating device is provided inside the barrel between the air inlet and the air outlet. A reservoir is mounted adjacent to the air outlet of the barrel and contains a liquid, such as water or hair conditioning solution. The reservoir has a hole and a liquid-permeable member which is inserted in the hole and which extends into the barrel. A heat conducting member is connected to the electric heating device and is disposed adjacent to the liquid-permeable member in order to allow the liquid to evaporate and to be entrained in the air stream.

3 Claims, 4 Drawing Sheets

HAIR APPLIANCE FOR DIRECTING WARM AIR TO HAIR

BACKGROUND OF THE INVENTION

1. Field of the Invention

This invention relates to hair care appliances, such as warm air brushes and hair dryers, for directing a stream of warm air to the air, more particularly to a hair appliance which includes a mechanism for entraining the vapor of a liquid, such as water or hair conditioning solution, in the stream of air so as to apply the vapor to the hair.

2. Description of the Related Art

Hair care appliances, such as hair dryers and warm air brushes, are widely used for hair grooming. The warm air applied to the hair can be used to facilitate styling of one's hair. In addition, a proper amount of hair conditioning solution may be applied or sprayed onto the hair before the warm air is applied by means of the hair care appliances to the hair in order to protect the hair from being damaged by wind, sunlight, rain water, and/or from the warm air produced by the hair dryers.

To facilitate combing and styling of the hair by means combs and hair care appliances, the hair is usually moistened by applying water or hair conditioning solution to the hair. However, the amount of the water or hair conditioning solution which is to be applied is hard to control. This causes the hair to become insufficiently wet or too wet and can also result in an uneven distribution of the hair conditioning solution.

SUMMARY OF THE INVENTION

It is therefore a main object of this invention to provide a hair care appliance which includes a mechanism for entraining the vapor of a liquid, such as water or hair conditioning solution, in the stream of air so that the vapor can be properly and evenly applied to the hair.

Accordingly, the hair care appliance of the present invention is used to direct a stream of warm air towards the hair and comprises:

an enlongated barrel having an air inlet and an air outlet opposite to the air inlet;

an electric heating device provided inside the barrel between the air inlet and the air outlet;

an electric fan mounted adjacent to the air inlet of the barrel to propel a stream of air from the air inlet to the air outlet through the electric heating device;

a reservoir mounted adjacent to the air outlet of the barrel, said reservoir containing a liquid therein and having a hole and a liquid-permeable member inserted in the hole and extending into the barrel;

means for fastening the reservoir adjacent to the air outlet of the barrel; and a heat conducting member connected to the electric heating device and disposed adjacent to the liquid-permeable member in order to allow the liquid to evaporate and to be entrained in the air stream.

Other features and advantages of this invention will become apparent in the following detailed description of the preferred embodiments of this invention with reference to the accompanying drawings.

DETAILED DESCRIPTION OF THE PREFERRED EMBODIMENTS

Figure 1:
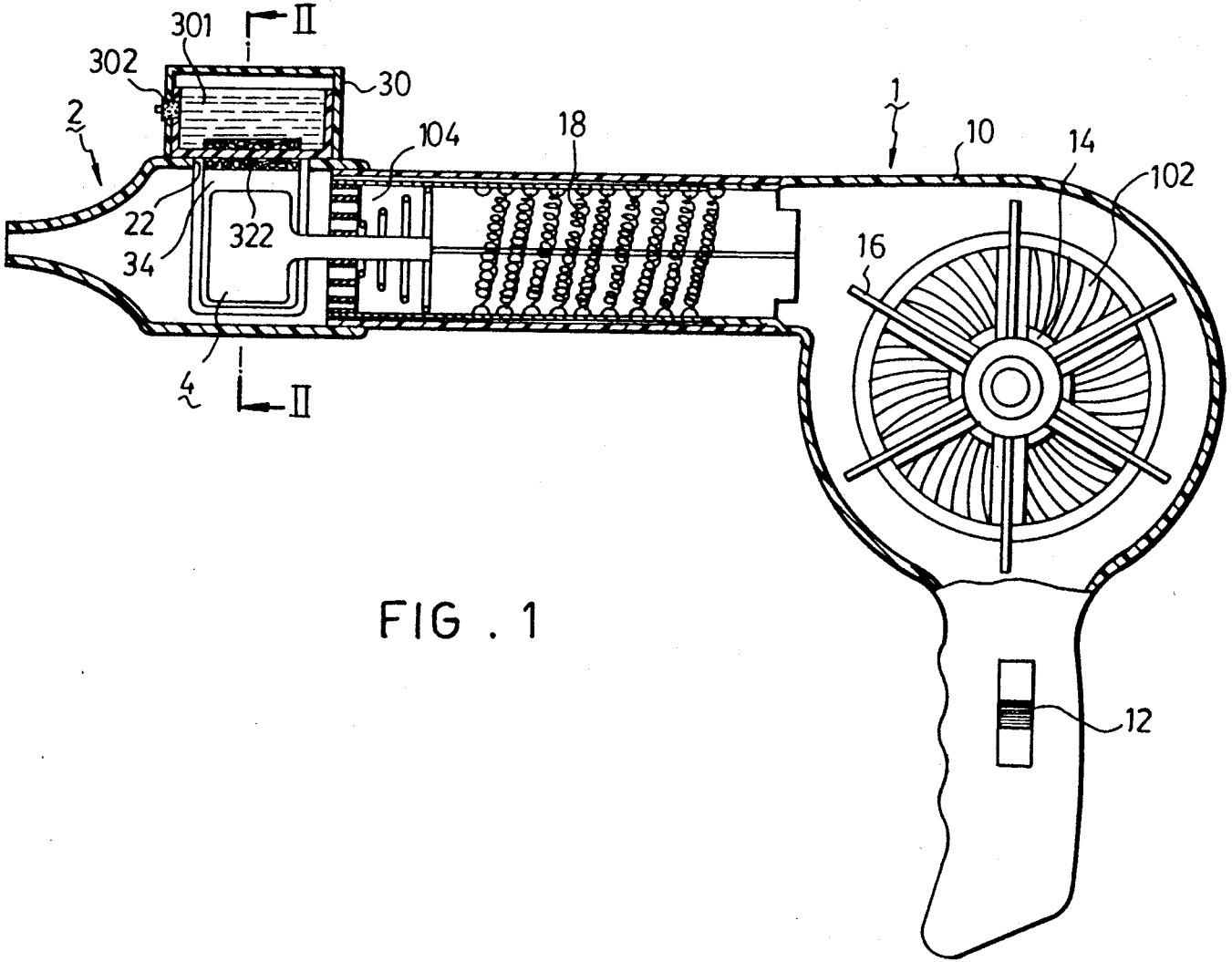
FIG. 1 is a partial sectional view of a first preferred embodiment of a hair care appliance of this invention.

FIG. 1 shows a partial sectional view of the first preferred embodiment of a hair care appliance of this invention. The hair care appliance includes a conventional electric hair dryer 1 and an air concentrator 2 mounted on an air outlet 104. The electric hair dryer 1 includes an elongated barrel 10 having an air inlet 102 opposite to the air outlet 104, and an electric heating device 18 provided in the barrel 10 between the air inlet 102 and the air outlet 104. An electric fan 16 is mounted adjacent to the air inlet 102 of the barrel 10 to propel a stream of air from the air inlet 102 to the air outlet 104 through the electric heating device 18. The electric fan 16 is driven by a motor 14. An actuating switch 12 is provided on the handle of the electric hair dryer 1 for actuating the motor 14 and the electric heating device 18 in a known manner. The air concentrator 2 is sleeved onto the air outlet 104 of the hair dryer 1.

Figure 2:
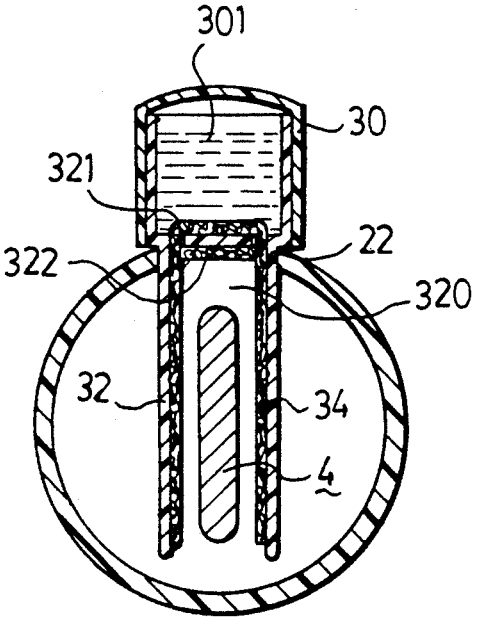
FIG. 2 is a sectional view taken along the line II—II of FIG. 1.

A reservoir 30 is mounted on the air concentrator 2 adjacent to the air outlet 104 of the barrel 10. The reservoir 30 contains a liquid 301, such as water or hair conditioning solution, therein. The reservoir 30 has a liquid supplying hole 302 provided thereto. The bottom of the reservoir 30 has two parallel elongated holes 321 and a strip of liquid-permeable member 34, which is made of a material such as a fire-proof cotton. Two opposed plate members 32 depend from the bottom of the reservoir 30 and pass through a rectangular fixing hole 22 formed in the air concentrator 2 in order to position the reservoir 30 on the air concentrator 2. A receiving space 320 is formed between the two opposed plate members 32. The liquid-permeable member 34 passes through the parallel elongated holes 321 and the fixing hole 22 and extend into the air concentrator 2, as best illustrated in FIG. 2. A heat insulating member 322 is provided at the external face of the bottom of the reservoir 30. Therefore, the liquid-permeable member 34 can be dipped in the liquid 301 and is entirely moistened by means of capillary attraction. The liquid-permeable member 34 is attached to the opposed faces of the opposed plate members 32.

A heat conducting member 4 is connected to the electric heating device 18 and is disposed in the receiving space 320 between the opposed plate members 32. When the electric heating device 18 is actuated, the heat conducting member 4 is heated. The liquid-permeable member 34 is thus heated and the liquid 301 absorbed by the liquid-permeable member 34 is evaporated. Therefore, the liquid 301 can be entrained in the warm air stream that flows through the outlet 104 of the hair dryer 1 and can be applied to the hair for combing and conditioning purposes. The heat insulating member 322 prevents the reservoir 30 from being damaged due to high temperature conditions.

Figure 3:
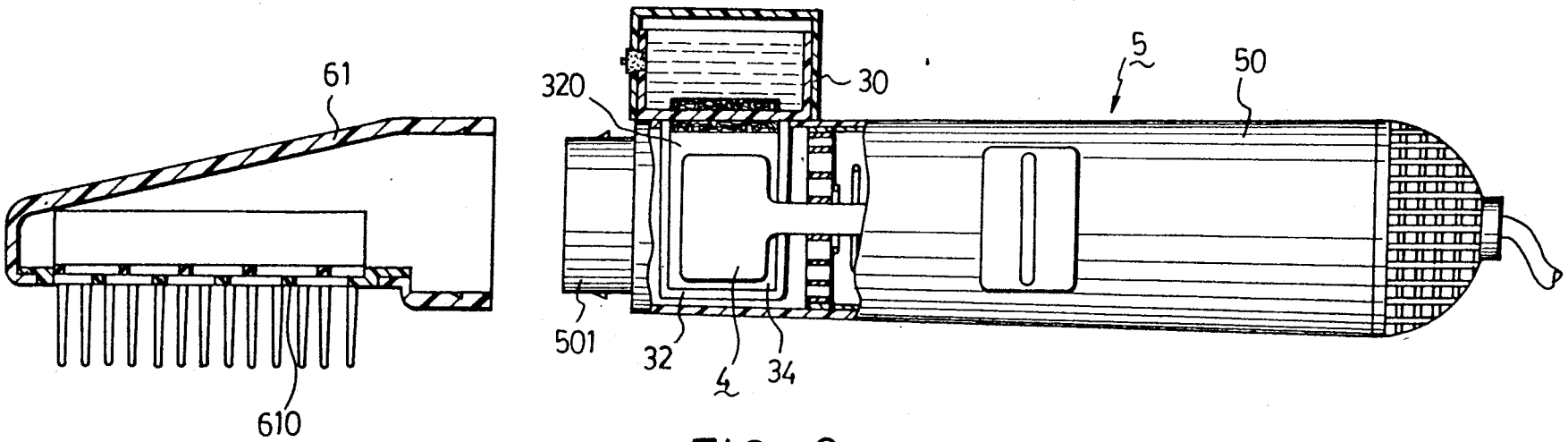
FIG. 3 is a partial sectional view of a second preferred embodiment of a hair care appliance of this invention.
Figure 4:
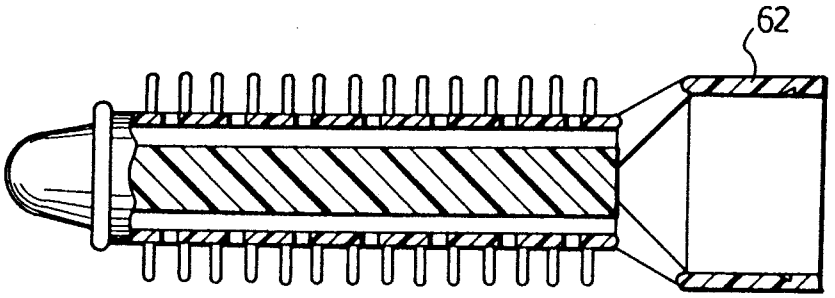
FIG. 4 is a partial sectional view of a curler of a hair care appliance of this invention.

FIG. 3 shows a partial sectional view of a second preferred embodiment of a hair care appliance of this invention. In this embodiment, the reservoir 30 is mounted to the barrel 50 of a warm air brush 5 adjacent to the air outlet 501 of the barrel 50. The heat conducting member 4 is disposed in the receiving space 320 between the opposed plate members 32 and the liquid permeable member 34 in a manner similar to that which was employed in the first preferred embodiment. A hair comb member 61 is sleeved onto the air outlet 501 of the barrel 50. The warm air stream that is entrained with liquid vapor can be applied to the hair through the vent holes 610 when the appliance is in use. Alternatively, the warm air brush 61 can be replaced with a hair curler 62, as shown in FIG. 4.

Figure 5:
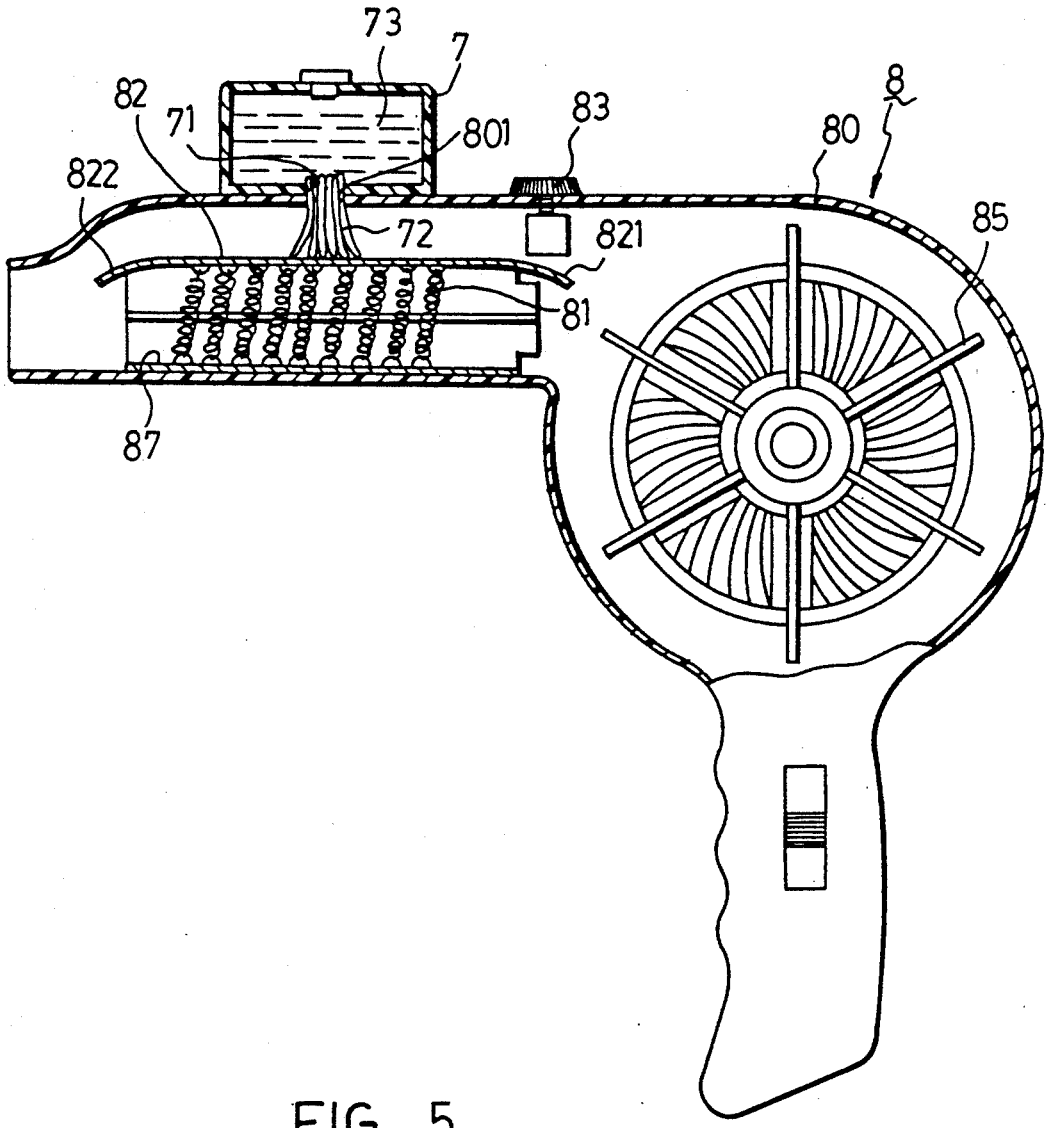
FIG. 5 is a sectional view of a third preferred embodiment of the hair care appliance of this invention.

FIG. 5 shows a partial sectional view of a third preferred embodiment of a hair appliance of this invention. In this embodiment, a reservoir 7 contains liquid 73 and has a hollow projection 71 that protrudes in a fixing hole 801 which is formed in the barrel 80 of a hair dryer 8. A bundle of liquid-permeable members 72 is fitted in the hollow projection 71 in order to deliver the liquid 77 to the outside of the reservoir 7. An elongated metal plate 82 is disposed above the electric heating device 81 of the hair dryer 8. The liquid-permeable member 72 is disposed on the top face of the metal plate 82. The metal plate 82, has a rear downward inclined edge 821 at the upstream end of the air stream and a front downward inclined edge 822 at the downstream end of the air stream. Therefore, the stream of air from the fan 85 will be divided into an upper stream of warm air which is entrained with liquid vapor as described in the previous embodiments through the upper side of the metal plate 82, and a lower stream of warm air through the lower side of the metal plate 82. The upper and lower stream of air will mix and exit from the air outlet 87 of the barrel 80 for hair caring purposes. The vapor content of the upper stream of warm air may be adjusted by opening an adjusting valve 83 that is disposed adjacent to the rear downward inclined edge 821 of the metal plate 82 and that is used to control the amount of air which passes above the metal plate 82.

With this invention thus explained, it is apparent that numerous modifications and variations can be made without departing from the scope and spirit of this invention. It is therefore intended that this invention be limited only as indicated in the appended claims.

I claim:

1. A hair care appliance for directing a stream of warm air towards the hair, comprising:

an elongated barrel having an air inlet and an air outlet opposite to said air inlet;

an electric heating device provided inside said barrel between said air inlet and said air outlet;

an electric fan mounted adjacent to said air inlet of said barrel to propel a stream of air from said air inlet to said air outlet through said electric heating device;

a reservoir mounted adjacent to said air outlet of said barrel, said reservoir containing a liquid therein and having a hole and a liquid-permeable member inserted in said hole and extending into aid barrel;

means for fastening said reservoir adjacent to said air outlet of said barrel; and a heat conducting member connected to said electric heating device and disposed adjacent to said liquid-permeable member in order to allow said liquid to evaporate and to be entrained in said air stream, wherein said heat conducting element is an elongated metal plate disposed above said electric heating device, said metal plate having a rear downward inclined edge at an upstream end of said air stream and a front downward inclined edge at a downstream end of said air stream, and said barrel having an adjusting valve adjacent to said rear downward inclined edge of said metal plate in order to control the amount of air passing above said metal plate.

2. A hair care appliance for directing a stream of warm air toward the hair, comprising:

an elongated barrel having an air inlet and an air outlet opposite to said air inlet;

an electric heating device provided inside said barrel between said air inlet and said air outlet;

an electric fan mounted adjacent to said air inlet of said barrel to propel a stream of air from said air inlet to said air outlet through said electric heating device;

a reservoir mounted adjacent to said air outlet of said barrel, said reservoir containing a liquid therein and having a hole and a liquid-permeable member inserted in said hole and extending into said barrel;

means for fastening said reservoir adjacent to said air outlet of said barrel; and a heat conducting member connected to said electric heating device and disposed adjacent to said liquid-permeable member in order to allow said liquid to evaporate and to be entrained in said air stream, wherein said air outlet of said barrel has an air concentrator provided thereon, said reservoir being mounted to said air concentrator, wherein said air concentrator has a fixing opening formed therein, said fastening means including two opposed plate members extending from a bottom of said reservoir into said air concentrator through said fixing opening, and said liquid-permeable member being attached to opposed faces of said opposed plate members.

3. A hair care appliance for directing a stream of warm air toward the hair, comprising:

an elongated barrel having an air inlet and an air outlet opposite to said air inlet;

an electric heating device provided inside said barrel between said air inlet and said air outlet;

an electric fan mounted adjacent to said air inlet of said barrel to propel a stream of air from said air inlet to said air outlet through said electric heating device;

a reservoir mounted adjacent to said air outlet of said barrel, said reservoir containing a liquid therein and having a hole and a liquid-permeable member inserted in said hole and extending into said barrel;

means for fastening said reservoir adjacent to said air outlet of said barrel; and a heat conducting member connected to said electric heating device and disposed adjacent to said liquid-permeable member in order to allow said liquid to evaporate and to be entrained in said air stream, wherein said barrel has a fixing opening formed therein, said fastening means including two opposed plate members extending from a bottom of said reservoir into said barrel through said fixing opening, and said liquid-permeable member being attached to opposed faces of said opposed plate members.

* * * * *